US009289102B2

(12) United States Patent
Seibt et al.

(10) Patent No.: US 9,289,102 B2
(45) Date of Patent: Mar. 22, 2016

(54) DISPOSABLE SEATING-SURFACE COVER FOR A TOILET-SEAT FLAP, AND TOILET MODULE

(71) Applicant: AIRBUS OPERATIONS GMBH, Hamburg (DE)

(72) Inventors: Christian Seibt, Buchholz i.d.N. (DE); Jorinde Wittkugel, Bad Fallingbostel (DE)

(73) Assignee: AIRBUS OPERATIONS GMBH, Toulouse (FR)

( * ) Notice: Subject to any disclaimer, the term of this patent is extended or adjusted under 35 U.S.C. 154(b) by 686 days.

(21) Appl. No.: 13/656,062

(22) Filed: Oct. 19, 2012

(65) Prior Publication Data

US 2013/0111656 A1 May 9, 2013

Related U.S. Application Data

(60) Provisional application No. 61/549,779, filed on Oct. 21, 2011.

(30) Foreign Application Priority Data

Oct. 21, 2011 (DE) ..... 10 2011 116 662

(51) Int. Cl.
*A47K 13/14* (2006.01)
*A47K 13/16* (2006.01)

(52) U.S. Cl.
CPC ..... *A47K 13/14* (2013.01); *A47K 13/16* (2013.01); *A47K 13/165* (2013.01)

(58) Field of Classification Search
CPC ..... A47K 13/16; A47K 13/165; A47K 13/18; A47K 13/14
USPC ..... 4/244.1–244.3, 245.3–245.5
See application file for complete search history.

(56) References Cited

U.S. PATENT DOCUMENTS

| | | | | |
|---|---|---|---|---|
| 4,451,940 | A | 6/1984 | Grunz | |
| 4,979,237 | A * | 12/1990 | Hazar et al. | 4/244.1 |
| 5,193,231 | A | 3/1993 | Stender | |
| 2005/0109031 | A1 | 5/2005 | Inaba | |
| 2007/0101483 | A1 | 5/2007 | Ohba | |

FOREIGN PATENT DOCUMENTS

| | | |
|---|---|---|
| CH | 678 916 | 11/1991 |
| DE | 6812233 | 9/1969 |
| DE | 1815751 | 7/1970 |
| DE | 2 021 142 | 11/1971 |
| DE | 199 15 324 | 10/2000 |
| DE | 101 00 962 | 7/2002 |
| DE | 101 02 298 | 8/2002 |
| DE | 10 2004 055 695 | 6/2005 |
| DE | 10 2006 029 800 | 12/2007 |
| DE | 20 2007 012 920 | 3/2009 |
| JP | 2008/029807 | 2/2008 |
| WO | 2005/092167 | 10/2005 |

* cited by examiner

*Primary Examiner* — Tuan N Nguyen
(74) *Attorney, Agent, or Firm* — Dickinson Wright PLLC

(57) ABSTRACT

A disposable seating-surface cover for a toilet-seat flap is configured to cover a seating surface of a toilet-seat flap in order to avoid contact between a user and the toilet-seat flap. The disposable seating-surface cover includes a deformable or foldable base section with an aperture. The disposable seating-surface cover further includes at least one adhesive section which is arranged on or in the base section and is made of a paramagnetic or ferromagnetic material.

18 Claims, 6 Drawing Sheets

DISPOSABLE SEATING-SURFACE COVER FOR A TOILET-SEAT FLAP, AND TOILET MODULE

Figures 1A, 1B:
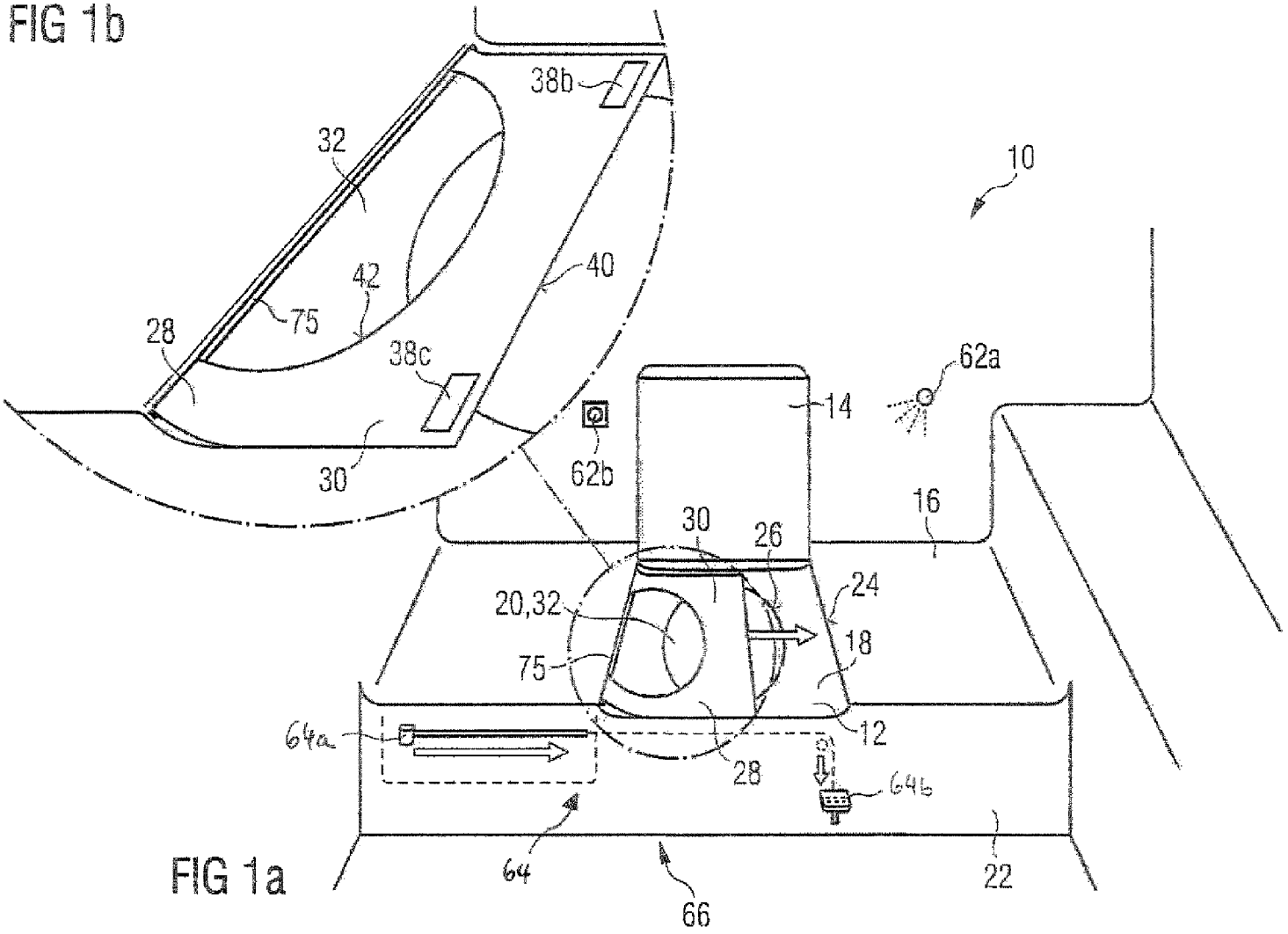

The invention relates to a disposable seating-surface cover for a toilet-seat flap and to a toilet module, particularly for installation in an aircraft, which is intended to operate in conjunction with a disposable seating-surface cover of this kind.

Toilet modules and covers for toilet-seat flaps are known from the prior art.

CH 678 916 A5 describes an aircraft toilet with a dispenser for faecal pouches. Suction apertures which are in communication with a suction line are provided in a foldable rim of the seat. When the rim of the seat is in the folded-up condition, it rests against the foremost faecal pouch in the stack of a dispenser and retains the pouch by means of negative pressure. If the rim of the seat is folded down, it takes with it the pouch, which then projects, folded open, into the pan. After use, the negative pressure in the suction apertures is discontinued and a flap underneath the pouch is opened. Alternatively, instead of the rim of the seat, the dispenser may be folded, swung sideways or pushed onto said rim of the seat.

DE 2 021 142 OS relates to an aircraft closet. In this case, there are provided bags which are adapted to the interior space of a closet bowl and receive the faeces and which can be inserted mechanically and have a paper lining for a rim of the seat. A closet lid, which is mounted so as to be displaceable along a track and which has a groove, is provided for closing off the bowl. The bags are received in a store and have, on their lining, a bead which fits into the groove in the lid. In the course of the opening operation, the lid is placed with its groove over the bead of the next lining and entrains the latter on closing. A suction device may be provided, instead of the groove and bead, for entraining the lining.

DE 101 00 962 A1 relates to a toilet facility for an aircraft. An annular storage receptacle for receiving a hose-like film is provided on a rim of a toilet bowl. The film is wound onto a roll or folded up in a fan-like manner, is applied against the inner surface of the bowl and leads as far as a worm conveyor arranged in a waste-disposal aperture. After the toilet has been used, the contaminated part of the film, together with the contents, is conveyed onwards into a collecting line by means of the worm, until the bowl is lined with clean film.

DE 101 02 298 C1 likewise relates to a toilet facility for an aircraft. In this case, the toilet-seat flap is covered with a toilet-seat overlay which is wound onto a draw-off roller and in which a pouch of film is retained by means of perforation. Said toilet-seat overlay leads to a receiving roller which, after each cycle of use, winds up a specific length of the seat overlay as a result of driving via a motor. When a pouch of film is located in the centre of the toilet bowl, the receiving roller is stopped and the pouch of film is unfolded downwards into the bowl by the application of a negative pressure.

DE 199 15 324 A1 relates to a toilet-seat flap with a contact-protecting overlay. Located above the seat-flap is a toilet lid in which a stack of paper is accommodated. In the seat-flap there is provided a motor-driven gripper arrangement which removes a contact-protecting paper from the stack with the aid of a rubber gripper, brings it into position and holds it fast by clamping it in. The lid is then folded upwards in a motor-driven manner in order to pull the paper completely out of the stack and deposit it on the surface of the seat-flap.

DE 10 2006 029 800 A1 relates to a toilet system in an aircraft. In this case, a storage receptacle for lengths of film is provided next to a toilet seat with a toilet-seat flap. An automated infeed apparatus has two electrically driven arms with a gripper which, as a result of a pneumatically driven folding movement, grasps a length of film in the region of the storage receptacle, pulls it forward and arranges it over the seat. The length of film is then applied by suction by means of a vacuum apparatus and is clamped in between a clamping ring and the seat-flap as a result of a pneumatically driven clamping movement. The rear end of the length of film is clamped in by means of a pneumatically driven clamping and severing apparatus.

DE 20 2007 012 920 U1 relates to a toilet in which a pouch is inverted over the rim of a WC seat. Located to the side of the seat is a movable slide, during the displacement of which the used pouch is entrained and pushed by a flap, so that said pouch drops into a receptacle arranged to the side. The slide is driven by an electric motor.

It is desirable, while adopting the prior art as the starting point, to further improve the hygiene of a toilet module. It is also desirable and necessary, particularly when a toilet module is used in an aircraft, to reduce the noise emissions emanating from a toilet module and to expand the possibilities for the multiple use of such a module.

The object towards which the invention is directed is to indicate a disposable seating-surface cover for a toilet-seat flap, and a toilet module, particularly for installation in an aircraft, which make possible a high standard of hygiene.

This object is achieved by means of a disposable seating-surface cover for a toilet-seat flap having the features in claim 1, and by means of a toilet module having the features in claim 5.

A disposable seating-surface cover according to the invention is adapted to cover a seating surface of a toilet-seat flap in order to avoid contact between a user and said toilet-seat flap. It is preferably possible for the disposable seating-surface cover to cover the seating surface of the toilet-seat flap in such a way that, when sitting on said seating surface of the toilet-seat flap, a user has no direct contact of any kind with the toilet-seat flap itself via his or her buttocks.

For this purpose, the disposable seating-surface cover comprises a deformable or foldable base section with an aperture. With the aid of said deformable or foldable base section, the disposable seating-surface cover can be folded, deformed or crumpled to a compact size in such a way that, in its compacted state, said disposable seating-surface cover can be disposed of without difficulty through a standard or conventional waste-disposal line belonging to a toilet module, particularly a toilet module for installation in an aircraft. The surface area of the base section is preferably the same as, or larger than, the seating surface, which is to be covered for hygiene purposes, of the toilet-seat flap. The geometry, particularly the flat shape of the un-deformed/unfolded base section may be adapted to the geometry, in particular, of the seating surface of the toilet-seat flap in such a way that said base section covers, at least partially and preferably completely, the seating surface of said toilet-seat flap. In particular, the aperture in the base section is adjusted, in its size, position and/or orientation, to the aperture in the toilet-seat flap when the disposable seating-surface cover is in the state of use. The base section may be constructed as a film, a sheet of paper or a membrane which is suitable for protecting the user from contamination and/or wetness when sitting on the seating surface of the toilet-seat flap. The base section is preferably water-repellent and/or impermeable to water. The material of which the base section entirely, partially or mostly consists may be selected from a group that includes: paper, cardboard, plastic, laminate and composite material.

The disposable seating-surface cover further comprises at least one adhesive section which is arranged on or in the base section and is made of a paramagnetic or ferromagnetic material. Said adhesive section may be structurally integrated into the base section or may border on the latter. For example, the adhesive section may be bonded, pressed or welded onto or into the base section. The material of which the adhesive section entirely, partially or mostly consists has a magnetic permeability $\mu_r>1$, preferably $\mu_r>1+10^{-5}$, and particularly preferably $\mu_r>>1$, particularly $\mu_r>300$. The paramagnetic or ferromagnetic material may be selected from a group that includes: iron, cobalt, nickel, ferrite, mu-metal, ferromagnetic metal, paramagnetic plastic or ferromagnetic plastic.

The disposable seating-surface cover according to the invention makes it possible, with the aid of its paramagnetic or ferromagnetic adhesive section, to interact with another device, for example with a retaining apparatus or conveying apparatus comprising a magnet or a paramagnetic material, in order to be conveyed, with the aid of a magnetic force, to the point of use on the seating surface of the toilet-seat flap and to be held fast securely at that point. Thanks to the adhesive section, the disposable seating-surface cover can also be retained so as to rest on the seating surface in a tautly stretched, flat and smooth manner. This particularly prevents the disposable seating-surface cover from slipping, for example when a user sits down on the seating surface of the toilet-seat flap, moves about on the latter or gets up from the latter again. In each case, direct contact between the user and the toilet-seat flap is avoided. A high standard of hygiene is thus guaranteed.

A further advantage of the disposable seating-surface cover according to the invention consists in the fact that the non-slip retention of the disposable seating-surface cover on the seating surface of the toilet-seat flap is brought about by magnetic force. When it is brought about in this way, it is possible to dispense with movable parts such as mechanical clamps for clamping-in the disposable seating-surface cover on or at the toilet-seat flap, or with maintenance-intensive retaining systems such as pump-operated sucking-on devices for sucking said disposable seating-surface cover onto the toilet-seat flap, which are generally also difficult or awkward to clean. If the opposing magnetic poles of the adhesive section of the disposable seating-surface cover, such as magnets or metal parts for example, are structurally integrated into the toilet-seat flap, it is even possible to design the latter, viewed from the outside, as a conventional toilet-seat flap, which additionally makes it easier to clean. It is thus possible to achieve the high standard of hygiene by means of the disposable seating-surface cover according to the invention in a manner which is cost-effective and also favourable from the maintenance point of view.

The adhesive section of the disposable seating-surface cover is preferably constructed as a metal strip, in particular as a paramagnetic metal strip. However, said adhesive section may also be constructed as a magnetic tape having a permanent external magnetic field. The metal strip may be incorporated in the base section. In order to avoid injuries or allergies, the metal strip is preferably incorporated in the base section in such a way that direct contact between said adhesive section and a user sitting on the seating surface of the toilet-seat flap is avoided. In order to avoid traces of wear, the metal strip is preferably incorporated in the base section in such a way that direct contact between the adhesive section and the toilet-seat flap is avoided. The geometry of the adhesive section may be constructed as a flat strip. Said strip may be of rectangular or square construction.

The base section may have a square, rectangular or a substantially square or rectangular outer periphery. The corners may be of rounded construction. Said base section may have a circular or elliptical or a substantially circular or elliptical inner periphery. The area described by the inner periphery and the area of the base section described by the outer periphery are preferably located concentrically in relation to one another.

The adhesive section may be arranged between an outer periphery and an inner periphery of the base section. In particular, the adhesive section may be arranged in the region of the corners of an outer periphery of the base section. Said adhesive section may be arranged, in the form of a strip, orthogonally in relation to the edges of an outer periphery of the base section.

In particular, the disposable seating-surface cover may comprise a plurality of adhesive sections, said adhesive sections of the disposable seating-surface cover being arranged, relative to one another, in such a way that, when a spatial movement (in particular a displacement or parallel displacement) of the disposable seating-surface cover occurs, the adhesive sections describe paths of motion along the direction of movement of said disposable seating-surface cover that extend parallel and in a manner spaced apart from one another. Two adjacent adhesive sections do not directly border on one another but are separated from one another by the base section or part of the latter.

A toilet module according to the invention comprises a toilet-seat flap with a seating surface and is adapted to interact with a disposable seating-surface cover which has been described above. Said toilet module may be intended, in particular, for use or installation in an aircraft, preferably a passenger aircraft. In addition, however, the toilet module may also be used or installed on a ship, in a land vehicle, in a mobile toilet unit or in a building. In particular, the toilet module is used at places where, over a certain period of time, a plurality of persons use one and the same facility for relieving their needs.

The toilet-seat flap is preferably constructed as a seating ring. Said toilet-seat flap may be constructed as a seating device, which can be folded up, in the form of a ring or of a ring that is discontinuous at one point, particularly at that front side of the toilet-seat flap which faces towards a user. As an alternative to this, however, the toilet-seat flap may also be integrated, that is to say designed in one piece with a toilet box. Said toilet-seat flap may be produced from a composite material, plastic, metal or wood. In particular, the toilet-seat flap is produced from a material which is hypoallergenic, washable and/or so stable that it withstands the load constituted by a user who is sitting on it. Said toilet-seat flap may have an aperture which is bounded entirely or partially by a ring or a discontinuous ring. The toilet-seat flap may have a square, rectangular or a substantially square or rectangular outer periphery. The corners of the outer periphery may be of rounded construction. The toilet-seat flap may have a circular or elliptical or a substantially circular or elliptical inner periphery. The inner periphery of the toilet-seat flap may define the aperture in said flap. The area described by the inner periphery and the area described by the outer periphery of the toilet-seat flap are preferably located concentrically in relation to one another.

The toilet module comprises a retaining apparatus. Said retaining apparatus is preferably arranged in the region of the toilet-seat flap. In particular, the retaining apparatus may be entirely or partially incorporated in said toilet-seat flap. Said retaining apparatus is adapted to retain the disposable seating-surface cover in a state of use. The state of use of the disposable seating-surface cover may represent a state of deformation, a size, a position and/or an orientation of said disposable seating-surface cover. When the disposable seating-surface cover is in the state of use, it is preferably suitable for use by a user. In particular, the disposable seating-surface cover may, when in the state of use, be arranged so as to lie directly on the seating surface of the toilet-seat flaps in a folded-out, un-deformed, flat, stretched, and/or smooth manner.

For the purpose of retaining the disposable seating-surface cover in its state of use, a magnetic force operates between the adhesive section of said disposable seating-surface cover and the retaining apparatus. Said magnetic force may bring about mutual adhesion between the disposable seating-surface cover and the retaining apparatus in such a way that said disposable seating-surface cover is retained entirely or partially in a slip-free and deformation-free manner in relation to the retaining apparatus. The disposable seating-surface cover and the retaining apparatus may adhere to one another directly or indirectly.

An inner periphery of the toilet-seat flap or a periphery of an aperture in said toilet-seat flap may be larger than an inner periphery of the base section of the disposable seating-surface cover. Said base section of the disposable seating-surface cover is then particularly adapted so as to extend, when in a state of use lying on the seating surface of the toilet-seat flap, from the latter into an aperture in said toilet-seat flap. The disposable seating-surface cover may therefore overhang the seating surface of the toilet-seat flap and/or hang down from the latter. Said disposable seating-surface cover may project into a toilet pan of the toilet module, which pan is arranged underneath the toilet-seat flap.

The retaining apparatus preferably comprises at least one magnet. Said magnet may be constructed as a permanent magnet or an electromagnet. A magnet which is constructed as a permanent magnet may permanently generate an external magnetic field having a magnetic field strength that differs from zero. A magnet which is constructed as an electromagnet may be connected to a control apparatus which comprises a voltage source and which is adapted to switch said electromagnet between an active and an inactive state. When the electromagnet is in the active state, it may generate an external magnetic field having a magnetic field strength that differs from zero. In an inactive state, the electromagnet substantially generates no external magnetic field, or only a very weak one. A magnet is preferably a bipolar magnet having two opposite poles. The adhesive section of the disposable seating-surface cover may be understood as being the opposite pole, or opposite poles, of the magnet. It is preferable if a plurality of magnets are arranged in the region of the toilet-seat flap in such a way that said magnets are spaced apart, particularly equidistantly, along the periphery of the aperture in the toilet-seat flap.

The adhesive section in the disposable seating-surface cover and the magnet in the retaining apparatus are preferably arranged and/or coordinated with one another in such a way that, when the disposable seating-surface cover is in the state of use, the magnetic force that operates between the adhesive section and the magnet of the retaining apparatus has a retaining value. The magnetic force is preferably adapted by the external magnetic field of the magnet and the material of the adhesive section.

The toilet module preferably comprises a waste-disposal system. Said waste-disposal system is preferably adapted to release the disposable seating-surface cover from the retaining apparatus, out of its state of use, with the aid of a sucking-away flow. Said waste-disposal system may also be adapted to convey the disposable seating-surface cover away towards a receiving compartment. Said receiving compartment may be a compartment in which the waste resulting from the use of the toilet module is also stored or intermediately stored. The sucking-away flow may be brought about by a suction consisting of flushing air which flows along because of a negative pressure or vacuum suction. For this purpose, the waste-disposal system may be connected to a flushing-air-generating plant, a negative-pressure-generating plant, a vacuum system and/or a suction-generating plant. The toilet module may be constructed as a vacuum-type toilet module. The sucking-away flow may flow over and/or under the disposable seating-surface cover. The sucking-away force that acts upon the disposable seating-surface cover during waste-disposal may correspond to a pressure difference of 650 mbar.

If the toilet module has a toilet lid, the waste-disposal system may be adapted to bring about the sucking-away of the disposable seating-surface cover both when the toilet lid is in an open state and when it is in a closed state. Said waste-disposal system may be adapted to control the sucking-away force brought about by the sucking-away flow in dependence upon the state of the toilet lid. The toilet module may comprise a spacer which is arranged and/or dimensioned, with respect to the disposable seating-surface cover when in the state of use and to the toilet-seat flap, in such a way that the disposable seating-surface cover is retained in its state of use exclusively by the retaining apparatus. In particular, the spacer may be designed in such a way that the disposable seating-surface cover, when in its state of use, is not clamped in between a toilet lid and some other component, even when said toilet lid is in the closed state.

The toilet module may comprise a triggering device which is adapted to control the waste-disposal system, when a triggering signal is received, in such a way that said waste-disposal system brings about the sucking-away of the disposable seating-surface cover.

The toilet module may comprise a sensor which is connected to the triggering device and which is adapted to generate a triggering signal and transmit it to said triggering device. Said sensor may be constructed as a movement sensor, a light barrier and/or a pressure sensor. It may generate the triggering signal automatically and/or with a time delay. The sensor may generate the triggering signal when a user has got up from the toilet-seat flap and/or when a user has moved away from the toilet module by a predetermined distance. The sensor may be constructed as a touch sensor which can be actuated by a user (for example a button, switch, key or raster) and which generates a triggering signal when a user actuates the sensor.

The toilet module may comprise an activator which is connected to the triggering device and which is adapted to generate a triggering signal and transmit it to the triggering device. Said activator may be constructed as a slide and/or a pedal, particularly a foot pedal. The activator may generate the triggering signal when actuated by a user. It may generate said triggering signal with a time delay.

The toilet module preferably comprises a conveying apparatus. Said conveying apparatus is preferably adapted to receive the disposable seating-surface cover when the latter is in a storage state. The storage state of said disposable seating-surface cover may represent a state of deformation, a size, a position and/or an orientation of said cover. When the disposable seating-surface cover is in the storage state, it is preferably suitable for storage in a storage reservoir. In particular, the disposable seating-surface cover may, when in the storage state, be arranged so as to be folded-together, compacted, deformed, flat, smooth, rolled up onto a storage roller and/or stacked in a storage stack.

The conveying apparatus is preferably adapted to convey the disposable seating-surface cover onto the seating surface of the toilet-seat flap. In doing so, the conveying apparatus may fold, unfold, deform, smooth, unroll and/or slide said disposable seating-surface cover. Finally, said conveying apparatus may be adapted to deposit the disposable seating-surface cover in its state of use. The conveying apparatus may transfer the disposable seating-surface cover from its storage state into its state of use.

A magnetic force preferably operates between the disposable seating-surface cover and the conveying apparatus for the purpose of conveying said disposable seating-surface cover. The magnetic force may bring about mutual adhesion between the disposable seating-surface cover and the conveying apparatus in such a way that said disposable seating-surface cover follows a preset movement. Said disposable seating-surface cover and said conveying apparatus may adhere to one another directly or indirectly.

The conveying apparatus may comprise at least one magnet. The above remarks regarding a magnet belonging to the retaining apparatus apply in an analogous way to a magnet belonging to the conveying apparatus. The adhesive section in the disposable seating-surface cover and the magnet in the conveying apparatus are preferably arranged and/or coordinated with one another in such a way that, during the conveying of the disposable seating-surface cover, the magnetic force that operates between the adhesive section and the magnet of the conveying apparatus has a conveying value.

The conveying apparatus may comprise at least one rail. Said rail may be of straight construction and/or extend substantially parallel to the seating surface of the toilet-seat flap. The conveying apparatus may comprise a conveying carriage. Said conveying carriage may be mounted so as to be displaceable with the aid of the rail. It can be displaced between a receiving state and a depositing state. In the receiving state, the conveying apparatus may receive the disposable seating-surface cover in its storage state. In the depositing state, the conveying apparatus may deposit the disposable seating-surface cover on the seating surface of the toilet-seat flap in its state of use. The conveying carriage may describe a non-curved or a curved path in the course of a displacement. Said conveying carriage preferably moves below a plane in which the toilet-seat flap is arranged.

The magnets of the conveying apparatus are preferably arranged on the conveying carriage in a fixed and immovable manner. A plurality of magnets belonging to the conveying apparatus are preferably arranged on the conveying carriage. In particular, the magnets belonging to the conveying apparatus are arranged on the conveying carriage in such a way that, when said conveying carriage is displaced, said magnets describe paths of motion that extend parallel and in a manner spaced apart from one another.

The triggering device described above may be adapted to control the conveying apparatus in such a way that, on receiving a triggering signal, said conveying apparatus brings about the transfer of the disposable seating-surface cover from its storage state into its state of use. Said triggering device may be adapted to first activate the waste-disposal system on receiving a triggering signal, and to then actuate the conveying apparatus, particularly with a time delay.

The activator described above may be adapted to displace the conveying carriage between the receiving state and the depositing state with the aid of a transmission of mechanical, kinematic, hydraulic and/or pneumatic construction. In this case, the transmission may be understood as being part of the triggering device. The activator may be pretensioned with the aid of a spring in such a way that, when the spring is in the non-tensioned state, the transmission displaces the conveying carriage into, and/or retains it in, its receiving state.

The retaining value of the magnetic force that operates, when the disposable seating-surface cover is in the state of use, between the adhesive section and the magnet of the retaining apparatus may be greater than the conveying value of the magnetic force that operates, when the disposable seating-surface cover is in the conveying state, between the adhesive section and the magnet of the conveying apparatus.

The number of magnets in the retaining apparatus and in the conveying apparatus is preferably the same. In particular, the magnets of the conveying apparatus are arranged, relative to one another, on the conveying carriage in such a way that their relative positions and/or orientations correspond precisely or substantially to the relative positions and/or orientations of the magnets of the retaining apparatus, or else have a small value, that differs from zero, in relation to the relative positions and/or orientations of the magnets of the retaining apparatus. In particular, the magnets of the conveying apparatus are arranged on the conveying carriage in such a way that they are located, when the conveying carriage is in the depositing state, in the vicinity of the magnets of the retaining apparatus in such a way that the magnetic force that operates between the adhesive section of the disposable seating-surface cover and the retaining apparatus exceeds the magnetic force that operates between the adhesive section of the disposable seating-surface cover and the conveying apparatus. In particular, the magnetic force that operates between the adhesive section of the disposable seating-surface cover and the retaining apparatus exceeds the magnetic force that operates between the adhesive section of the disposable seating-surface cover and the conveying apparatus in such a way that said disposable seating-surface cover is released from said conveying apparatus and passes over into the state of use in which it is retained by the retaining apparatus.

The adhesive section or sections, the magnet or magnets of the retaining device and the magnet or magnets of the conveying apparatus are, in particular, arranged relative to one another and adjusted to one another in such a way that, when the conveying carriage is in the depositing state, the magnetic force that operates between the adhesive section or sections of the disposable seating-surface cover and the retaining apparatus exceeds the magnetic force that operates between the adhesive section or sections of the disposable seating-surface cover and the conveying apparatus. The retaining value of the magnetic force that operates, when the disposable seating-surface cover is in the state of use, between the adhesive section or sections and the retaining apparatus may exceed the conveying value of the magnetic force that operates, when the disposable seating-surface cover is in the conveying state, between the adhesive section or sections and the conveying apparatus in such a way that said disposable seating-surface cover remains in its state of use as soon as the conveying carriage has reached its depositing state and then moves back into its receiving state.

The toilet module preferably comprises a storage reservoir in which a plurality of disposable seating-surface covers stacked on top of one another can be received in their storage state. Said storage reservoir may be constructed so as to be capable of being brought into the toilet module via a carrier device. In particular, there may be provided at least one spacer which is adapted to space adjacent disposable seating-surface covers apart from one another within the storage reservoir in such a way that the conveying apparatus receives only one disposable seating-surface cover when in the receiving state.

The toilet module may comprise a movable toilet lid. Said toilet lid preferably contains a sound-damping material. In particular, the toilet lid is adapted to conceal the toilet-seat flap when in a concealing state (that is to say, in a closed state).

When it is in an open state, the toilet lid may leave the toilet-seat flap clear. The toilet module may also comprise a toilet surround. Said toilet surround may contain a sound-damping material. In particular, the toilet surround may be arranged, relative to the toilet lid, in such a way that, in the concealing state, the toilet lid and the toilet surround form a seating surface that terminates in a substantially flush manner, and/or reduce a sound emission caused by the waste-disposal system of the toilet module.

Furthermore, any desired combination of the features of a disposable seating-surface cover and/or of a toilet module which have been set out herein is conceivably possible. Also, any desired combination of the features described below, which are explained in connection with the drawings, is conceivably possible.

The invention will be explained in greater detail below with the aid of the appended diagrammatic drawings, in which:

FIG. 1*a* shows a perspective representation of a toilet module;

FIG. 1*b* shows a detail view of the representation in FIG. 1*a;*

Figure 2A:
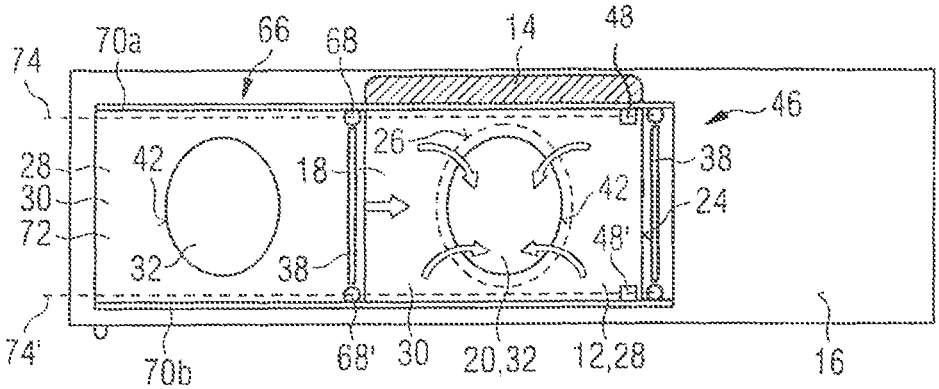
Figure 2B:
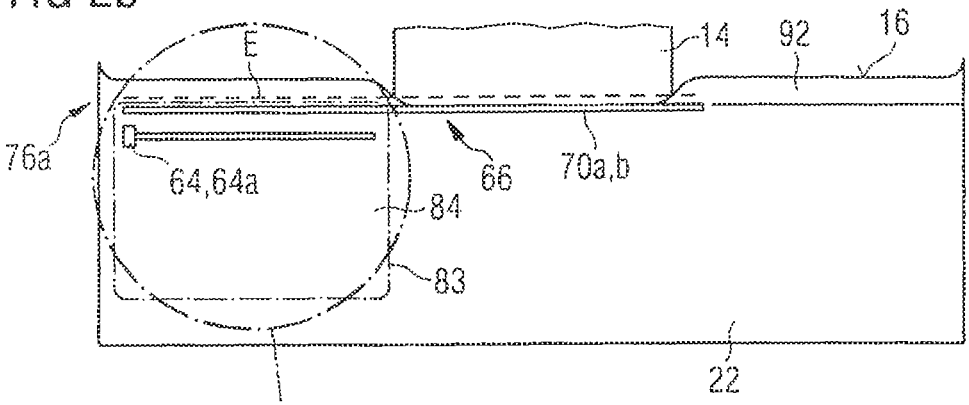
Figure 2D:
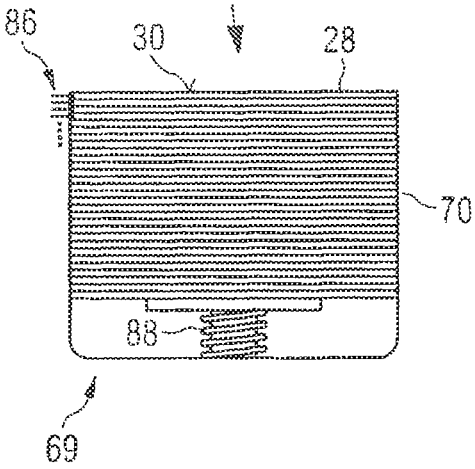
Figure 2C:
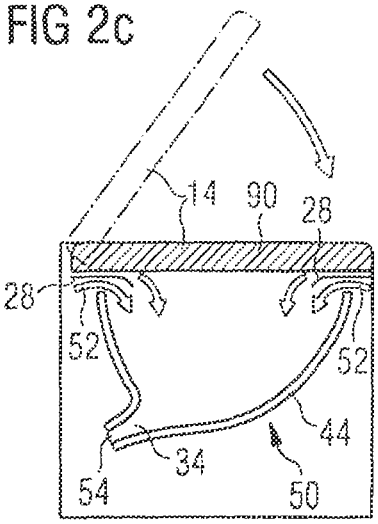

FIGS. 2*a* to 2*c* show a plan view and two side views of a toilet module;

FIG. 2*d* shows a detail view of the representation in FIG. 2*b;*

Figure 3A:
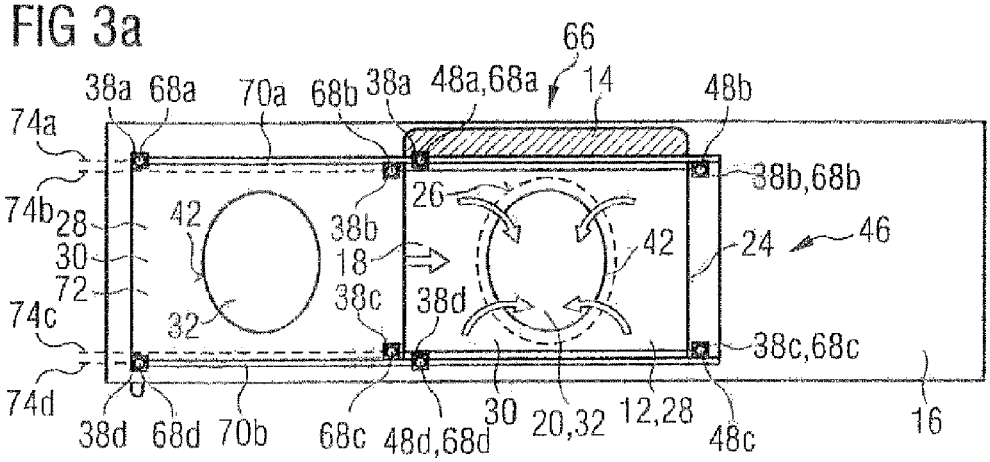
Figure 3B:
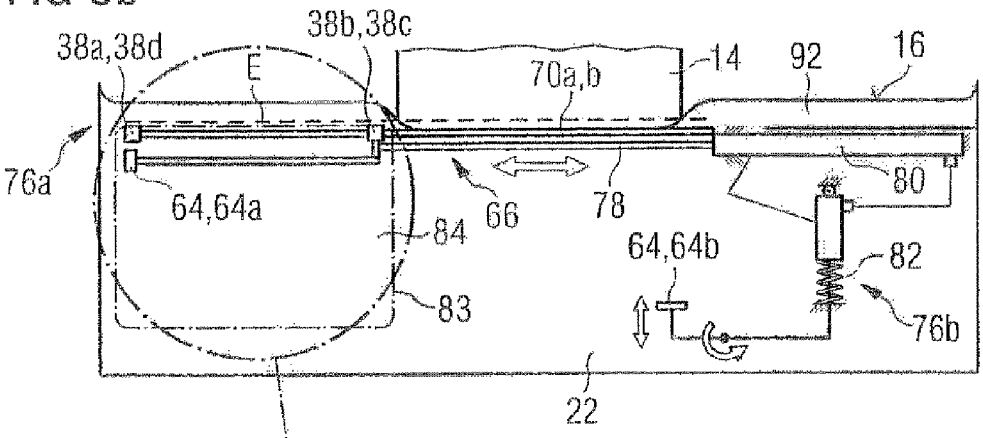
Figure 3D:
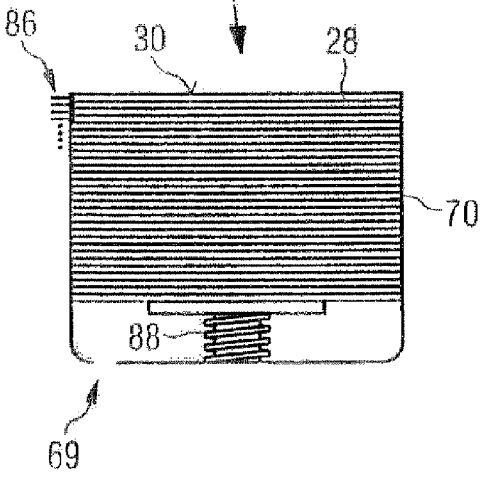
Figure 3C:
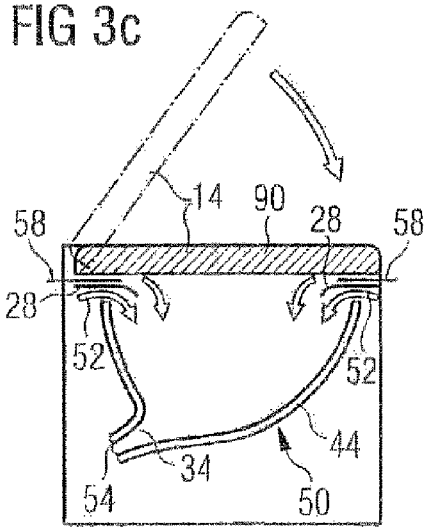

FIGS. 3*a* to 3*c* show a plan view and two side views of another toilet module;

FIG. 3*d* shows a detail view of the representation in FIG. 3*b;*

Figure 4:
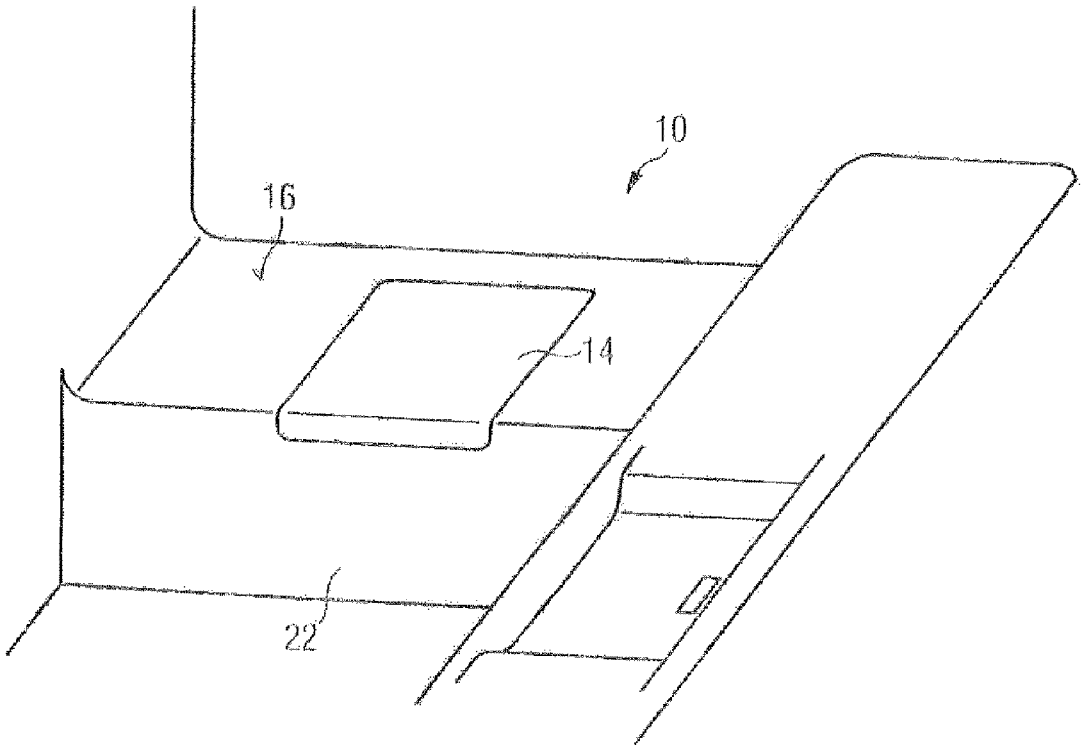
Figure 5A:
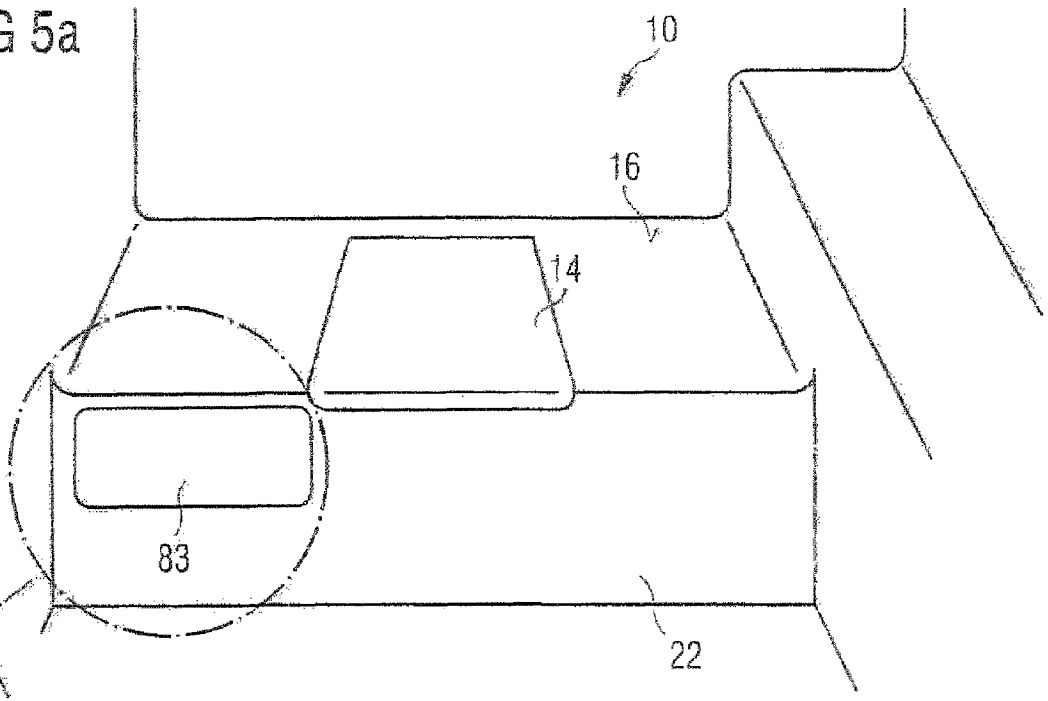
Figure 5B:
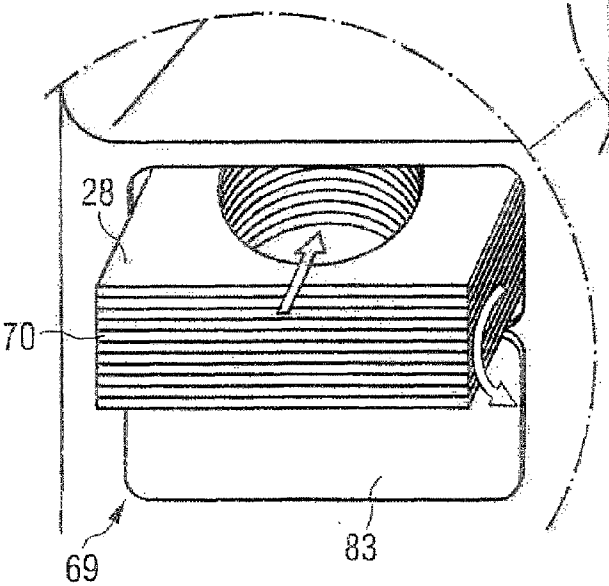

FIG. 4 shows a perspective representation of another toilet module;

FIG. 5*a* shows another perspective representation of another toilet module;

FIG. 5*b* shows a detail view of the representation in FIG. 5*a*; and

Figure 6:
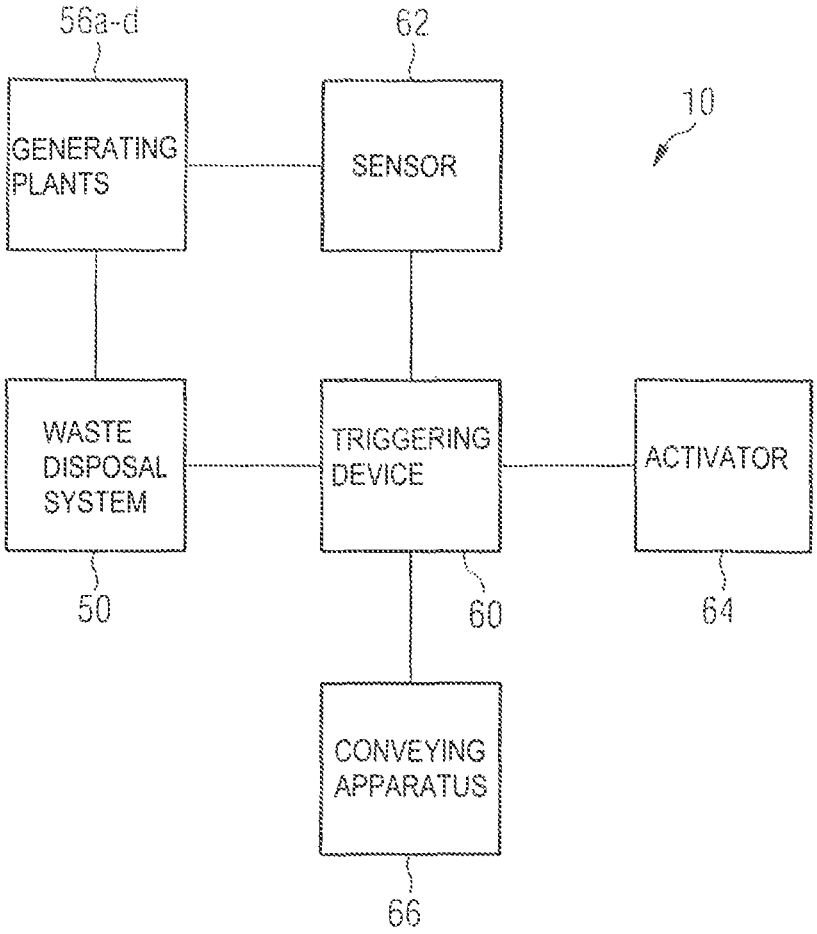

FIG. 6 shows another diagrammatic representation of another toilet module.

A toilet module which is shown in the drawings is designated generally by 10. Said toilet module 10 comprises a toilet-seat flap 12, a toilet lid 14 and a toilet surround 16. The toilet module 10 is particularly intended for use or installation in an aircraft, preferably a passenger aircraft.

As shown in FIGS. 2*c* and 3*c*, the toilet lid 14 is mounted so as to be foldable between a closed state (also a concealing state) and an open state. In FIGS. 1*a*, 2*a*, 2*b*, 3*a* and 3*b*, the toilet lid 14 is shown in its open state, whereas in FIGS. 4 and 5*a*, said toilet lid 14 is represented in its closed state.

The toilet-seat flap 12 has a seating surface 18, see particularly FIG. 1*a*. Said toilet-seat flap 12 is generally constructed as a seating ring, in which case there is understood to be, under said seating ring, a surface with an aperture 20 (a hole or a clearance). The toilet-seat flap 12 is an integral component of a toilet box 22, the upper side of which represents the toilet surround 16. The toilet-seat flap 12 is produced from a plastic which is hypoallergenic, washable and so stable that said toilet-seat flap 12 withstands the load constituted by a user who is sitting on it.

The toilet-seat flap 12 has a substantially rectangular outer periphery 24. The aperture 20 has a substantially elliptical inner periphery 26. The centre of the surface described by the inner periphery 26 and the centre of the surface described by the outer periphery 24 are located substantially concentrically in relation to one another; see particularly FIGS. 1*a*, 2*a* and 3*a*.

A disposable seating-surface cover 28 is adapted to cover the seating surface 18 of the toilet-seat flap 12 in order to avoid contact between a user and said toilet-seat flap 12. In a state of use, said disposable seating-surface cover 28 covers the seating surface 18 of the toilet-seat flap 12 in such a way that, when sitting on said seating surface 18 of the toilet-seat flap 12, a user has no direct contact of any kind with the toilet-seat flap 12 itself via his or her buttocks. When the disposable seating-surface cover 28 is in the state of use, it is suitable for use by a user and lies directly on the seating surface 18 of the toilet-seat flap 12 in a folded-out, un-deformed, flat and smoothly stretched manner; see FIGS. 2*a*, 2*b*, 3*a* and 3*b*, in the centre of the drawing in each case. The state of use of the disposable seating-surface cover 28 may be understood to be a position of use and an orientation of use of said cover.

The disposable seating-surface cover 28 comprises a deformable and foldable base section 30 with an aperture 32. Because of said base section 30, the disposable seating-surface cover 28 can be deformed, crumpled or compacted in such a way that, in its compacted state, it can be disposed of without difficulty through a standard or conventional waste-disposal line 34 belonging to the toilet module 10; see FIGS. 2*c* and 3*c*.

The surface area of the base section 30 is equal to the seating surface 18, which is to be covered for hygiene purposes, of the toilet-seat flap 12. Said base section 30 has a substantially rectangular outer periphery 40 and a substantially elliptical inner periphery 42. The centre of the surface area described by the inner periphery 42 and the centre of the surface area described by the outer periphery 40 are located substantially concentrically in relation to one another. The base section 30 is a membrane which is water-repellent and impermeable to water and which is suitable for protecting the user from contamination and/or wetness when sitting on the seating surface 18 of the toilet-seat flap 12.

The geometry/shape of the base section 30 is adapted to the geometry/shape of the toilet-seat flap 12 in such a way that said base section 30 completely covers the seating surface 18 of said toilet-seat flap 12. Furthermore, the aperture 36 in the base section 30 is adapted in its size, position and orientation, when the disposable seating-surface cover 28 is in the state of use, to the aperture 20 in the toilet-seat flap 12; see FIGS. 2*a* and 3*a*, in the centre of the drawing in each case.

In the form of embodiment shown in FIGS. 2*a* to 2*d*, the disposable seating-surface cover 28 has an adhesive section 38 which is incorporated in the base section 30 and is formed by a long metal strip consisting of a paramagnetic material (i.e., where $\mu_r>1$). In order to avoid traces of wear, said metal strip is incorporated in the base section 30 in such a way that direct contact between the adhesive section 38 and the toilet-seat flap 12 itself is avoided. Said adhesive section 38 is arranged between the outer periphery 40 and an inner periphery 42 of the base section 30, in the region of an edge of said outer periphery 40 of said base section 30.

In the form of embodiment shown in FIGS. 3*a* to 3*d*, the disposable seating-surface cover 28 has four adhesive sections 38a-d which are incorporated in the base section 30 and are constructed from metal strips consisting of a paramagnetic material (i.e., where $\mu_r>1$). Said adhesive sections 38*a-d* are arranged between the outer periphery 40 and an inner periphery 42 of the base section 30, in the region of the corners of said outer periphery 40 of the base section 30.

The base section 30 has an inner periphery 42 which is smaller than the periphery 26 of the aperture 20 in the toilet-seat flap 12; see FIGS. 2*a* and 3*a*. In particular, the base section 30 is adapted to extend, when lying on the seating surface 18 of the toilet-seat flap 12 in the state of use, from said toilet-seat flap 12 into the aperture 20 in the latter, and to overhang the seating surface 18 of the toilet-seat flap 12; see FIGS. 2*a*, 2*c*, 3*a* and 3*c*. The disposable seating-surface cover 28 may also hang down from the seating surface 18 of the toilet-seat flap 12 and project into a toilet pan 44 of the toilet module 10, which pan is arranged underneath the toilet-seat flap 12; see FIGS. 2*c* and 3*c*.

A retaining apparatus 46 is arranged in the region of the toilet-seat flap 12. This apparatus is incorporated in said toilet-seat flap 12. The retaining apparatus 46 is adapted to retain the disposable seating-surface cover 28 in its state of use. For the purpose of retaining said disposable seating-surface cover 28, a magnetic force operates between the adhesive section or sections 38, 38*a-d* of the disposable seating-surface cover 28 and the retaining apparatus 46. Said magnetic force brings about mutual adhesion between the disposable seating-surface cover 28 and the retaining apparatus 46 in such a way that said disposable seating-surface cover 28 is retained in a slip-free and deformation-free manner in relation to the retaining apparatus 26.

In the form of embodiment shown in FIGS. 2*a* to 2*d*, the retaining apparatus 46 has two magnets 48, 48'. Each magnet 48, 48' is constructed as a bipolar permanent magnet and permanently generates an external magnetic field having a magnetic field strength that differs from zero. The adhesive section 38 serves as an opposite pole to the magnets 48, 48'. The adhesive section 38 in the disposable seating-surface cover 28 and the magnets 48, 48' in the retaining apparatus 48 are arranged and/or coordinated with one another in such a way that, when the disposable seating-surface cover 28 is in the state of use, the magnetic forces that operate between the adhesive section 38 and the magnets 48, 48' have a total force with a retaining value $W_H$.

In the form of embodiment shown in FIGS. 3*a* to 3*d*, the retaining apparatus 46 has four magnets 48*a-d*. Each magnet 48*a-d* is constructed as a bipolar electromagnet which is connected to a control apparatus (of which no further details are represented) which comprises a voltage source and is adapted to switch the electromagnet between an active and an inactive state. When the electromagnet is in the active state, it generates an external magnetic field having a magnetic field strength that differs from zero. In an inactive state, the electromagnet substantially generates no external magnetic field, or only a very weak one. The adhesive sections 38*a-d* of the disposable seating-surface cover 28 each serve as an opposite pole to one of the magnets 48*a-d*. The adhesive sections 38*a-d* in the disposable seating-surface cover 28 and the magnets 48*a-d* in the retaining apparatus 46 are arranged and/or coordinated with one another in such a way that, when the disposable seating-surface cover 28 is in the state of use, the magnetic forces that operate between the adhesive sections 38*a-d* and the magnets 48*a-d* which are then in the active state have a total force with a retaining value $W_H$.

A waste-disposal system 50 is adapted to release the disposable seating-surface cover 28 from the retaining apparatus 46, out of its state of use, with the aid of a sucking-away flow 52, and to convey it away towards a receiving compartment 54. This is represented diagrammatically by the arrows in FIGS. 2*a*, 2*c*, 3*a* and 3*c*. The receiving compartment 54 is a compartment in which the excrement produced as a result of use of the toilet module 10 is also stored or intermediately stored. The sucking-away flow 52 may flow round the disposable seating-surface cover 28 from above and/or from below. Said sucking-away flow 52 is brought about by a suction consisting of flushing air which flows along because of a negative pressure or a vacuum suction. For the purpose of generating the sucking-away flow 52, the waste-disposal system may be connected to a flushing-air-generating plant 56*a*, a negative-pressure-generating plant 56*b*, a vacuum system 56*c* and/or a suction-generating plant 56*d*; see FIG. 6.

The waste-disposal system 50 is also adapted to bring about the sucking-away of the disposable seating-surface cover 28 both when the toilet lid 14 is in the open state and when it is in the closed state. The toilet module 10 comprises a spacer 58 which is arranged and dimensioned, with respect to the disposable seating-surface cover 28 when in the state of use and to the toilet-seat flap 12, in such a way that said disposable seating-surface cover 28 is retained in its state of use exclusively by the retaining apparatus 46, and is not clamped in between the toilet lid 14 and some other component, even when said toilet lid 14 is in the closed state; see FIG. 3*c*.

The toilet module 10 comprises a triggering device 60 which is adapted to control the waste-disposal system 50, on receiving a triggering signal, in such a way that said waste-disposal system 50 brings about the sucking-away of the disposable seating-surface cover 28; see FIG. 6. For this purpose, the toilet module 10 comprises a sensor 62 which is connected to the triggering device 60 and which is adapted to generate a triggering signal and transmit it to said triggering device 60. Said sensor 62 is constructed, for example, as a movement sensor 62*a*, a light barrier and/or a pressure sensor (see FIG. 1*a*) and generates a triggering signal automatically and/or with a time delay when a user has got up from the toilet-seat flap 12 or when a user has moved away from the toilet module 10 by a certain distance. Alternatively or in addition, the sensor 62 may be constructed as a touch sensor 62*b* which can be actuated manually by a user and which generates a triggering signal when actuated. The touch sensor 62*b* may be understood as being a toilet-flushing system.

Alternatively or in addition, the triggering device 60 is connected to an activator 64 which is constructed as a slide 64*a* or a foot pedal 64*b* and which is adapted to generate a triggering signal and transmit it to said triggering device 60; see FIG. 6. The activator 64 generates the triggering signal when actuated by a user. An activator 64, which is constructed merely as a slide 64*a*, can be seen in FIG. 2*b*. FIGS. 1*a* and 3*b*, on the other hand, show an activator 64 which is constructed as a slide 64*a* and a foot pedal 64*b*. The arrows in FIG. 1*a* indicate the directions in which the activator 64 can be moved when actuated. In the case of the activator, the triggering signal may be understood as being a mechanical, kinematic, pneumatic and/or hydraulic command for the purpose of bringing about a triggering action.

In addition, the toilet module 10 comprises a conveying apparatus 66. Said conveying apparatus 66 is adapted to receive the disposable seating-surface cover 28 when the latter is in a storage state (see FIGS. 2*a* and 3*a*, on the left-hand side of the drawing in each case, and also FIGS. 2*d* and 3*d*). When in the storage state, the disposable seating-surface cover 28 is arranged so as to be stored in a flat and smooth manner in a storage reservoir 69, under which circumstances it is particularly arranged in a storage stack 70; see FIGS. 2*a*, 2*d*, 3*a*, 3*d* and 5*b*.

The conveying apparatus 66 is adapted to convey the disposable seating-surface cover 28 onto the seating surface 18 of the toilet-seat flap 12. In doing so, the conveying apparatus 66 slides said disposable seating-surface cover 28, as represented by arrows in FIGS. 1*a*, 2*a* and 3*a*, and deposits said disposable seating-surface cover 28 on the seating surface 18 in its state of use. A magnetic force operates between the disposable seating-surface cover 28 and the conveying to apparatus 66 for the purpose of conveying said disposable seating-surface cover 28. The magnetic force brings about mutual adhesion between the disposable seating-surface cover 28 and the conveying apparatus 66 in such a way that said disposable seating-surface cover 28 follows a preset displacing movement. The conveying apparatus 66 therefore transfers the disposable seating-surface cover 28 from its storage state into its state of use.

In the form of embodiment shown in FIG. 2*a*, the conveying apparatus 66 comprises two magnets 68, 68'. Each magnet 68, 68' is constructed as a bipolar permanent magnet and permanently generates an external magnetic field having a magnetic field strength that differs from zero. The adhesive section 38 serves as an opposite pole to the magnets 68, 68'. The adhesive section 38 and the magnets 68, 68' in the conveying apparatus 66 are arranged and/or coordinated with one another in such a way that, during the conveying of the disposable seating-surface cover 28, the magnetic forces that operate between the adhesive section 38 and the magnets 68, 68' of the conveying apparatus 66 have a total force with a conveying value $W_T$.

In the form of embodiment shown in FIG. 3*a*, the conveying apparatus 66 comprises four magnets 68*a-d*. Each magnet 68*a-d* is constructed as a bipolar permanent magnet and permanently generates an external magnetic field having a magnetic field strength that differs from zero. An adhesive section 38*a-d* serves, in each case, as an opposite pole to one of the magnets 68*a-d*. The adhesive sections 38*a-d* in the disposable seating-surface cover 28 and the magnets 68*a-d* in the conveying apparatus 66 are arranged and coordinated with one another in such a way that, during the conveying of the disposable seating-surface cover 28, the magnetic force that operates between the adhesive sections 38*a-d* and the magnet 68*a-d* of the conveying apparatus 66 has a total force with a conveying value $W_T$.

The conveying apparatus 66 also comprises two rails 70*a*, 70*b*. Said rails 70*a, b* run parallel to one another and extend substantially parallel to the seating surface 18 of the toilet-seat flap 12; see FIGS. 2*a*, 2*b*, 3*a* and 3*b*. With the aid of the rails 70*a, b, a* conveying carriage 72 is mounted so as to be displaceable along said rails 70*a, b*. Under these circumstances, the conveying carriage 72 can be displaced between a receiving state (see FIGS. 2*a* and 3*a*, the left-hand side of the drawing in each case) and a depositing state (see FIGS. 2*a* and 3*a*, the centre of the drawing in each case). In the receiving state, the conveying apparatus 66 receives the disposable seating-surface cover 28 in its storage state. In the depositing state, the conveying apparatus 66 deposits the disposable seating-surface cover 28 on the seating surface 18 of the toilet-seat flap 12 in its state of use. The receiving state (depositing state) of the conveying carriage 72 may be understood as a receiving position (depositing position) of said carriage. In the course of the conveying operation, the conveying carriage 72 describes a displacement that follows a straight path. There is therefore substantially a parallel displacement of the disposable seating-surface cover 28 relative to the toilet-seat flap 12; see FIGS. 1*a*, 2*a* and 3*a*.

The magnets 68, 68', 68*a-d* of the conveying apparatus 66 are arranged on the conveying carriage 72 in a fixed and immovable manner in such a way that, when said conveying carriage 72 is displaced, said magnets 68, 68', 68*a-d* describe paths of motion 74, 74', 74*a-d* that extend parallel and in a manner spaced apart from one another; see FIGS. 2*a* and 3*a* respectively.

In the exemplified embodiment shown in FIG. 3*a*, this makes it possible, in particular, for no magnetic force, or only an insignificant one, to operate between the magnets 68*a* and 68*d* and the adhesive sections 38*b* and 38*c* when the conveying carriage 72 is displaced from the depositing state into the receiving state (from right to left in FIGS. 3*a* and 3*b*). The disposable seating-surface cover 28 is thus not torn away with it, in an unwanted manner, in a direction that faces away from the seating surface 18 of the toilet-seat flap 12. Only when the conveying carriage 72 has reached its receiving state (receiving position), does a magnetic force which is suitable for conveying the disposable seating-surface cover 28 operate between the magnets 68*a* and 68*d*. For the same reason, the adhesive sections 38*a-d* in this form of embodiment are also arranged, relative to one another, in such a way that, when the disposable seating-surface cover 28 is conveyed from the storage state into the state of use, the adhesive sections 38*a-d* describe paths of motion along the direction of movement of the disposable seating-surface cover 28 which run parallel to one another and are spaced apart from one another and which are likewise designated by 74*a-d* in FIG. 3*a*.

The adhesive section or sections 38, 38*a-d*, the magnets 48, 48', 48*a-d* of the retaining device and the magnets 68, 68', 68*a-d* of the conveying apparatus 66 are arranged relative to one another and adapted to one another in such a way that, when the conveying carriage 72 is in the depositing state, the magnetic forces that operate between the adhesive section or sections 38, 38*a-d* of the disposable seating-surface cover 28 and the retaining apparatus 46 exceed the magnetic forces that operate between the adhesive section or sections 38, 38*a-d* of the disposable seating-surface cover 28 and the conveying apparatus 66. The retaining value $W_H$ of the magnetic force that operates, when the disposable seating-surface cover 28 is in the state of use, between the adhesive sections 38*a-d* and the magnets 48*a-d* belonging to the retaining apparatus 46 is therefore greater than the conveying value $W_T$ of the magnetic force that operates, when the disposable seating-surface cover 28 is in the conveying state, between the adhesive sections 38*a-d* and the magnets 68*a-d* belonging to the conveying apparatus 66. As a result, the disposable seating-surface cover 28 remains in its state of use as soon as the conveying carriage 72 has once reached its depositing state and then moves back into its receiving state.

In FIG. 1*a*, it can be seen that the disposable seating-surface cover 28 and the conveying apparatus 66 do not adhere to one another directly. Instead, the conveying apparatus 66 is arranged, in relation to the disposable seating-surface cover 28 to be conveyed and to the toilet-seat flap 14, in such a way that, when the disposable seating-surface cover 28 is conveyed, the toilet-seat flap 14 is located between the conveying carriage 72 and said disposable seating-surface cover 28. For this purpose, the conveying carriage 72 moves below a plane E in which the toilet-seat flap 12 is arranged; see FIGS. 2*b*, 3*b*.

It can also be seen in FIG. 1*a*, that the toilet box has a slit 75. The conveying apparatus 66 is adapted to convey the disposable seating-surface cover 28 out of the toilet box 22 through the slit 75 and onto the seating surface 18.

The triggering device 60 is adapted to control the conveying apparatus 66, on receiving a triggering signal, in such a way that said conveying apparatus 66 brings about a transfer of the disposable seating-surface cover 28 from its storage state into its state of use. When this happens, the activator 64 described above comes into action: The activator 64, which is constructed as a slide 64*a* and/or a foot pedal 64*b*, is adapted to displace the conveying carriage 72 between the receiving state and the depositing state with the aid of a transmission 76*a* and 76*b* of mechanical, kinematic, hydraulic and/or pneumatic construction. Said transmission 76*a* is associated with the slide 64*a*, while the transmission 76*b* is associated with the foot pedal 64*b*. The transmissions 76*a, b* may be understood as being part of the triggering device 60.

The triggering device 60 may be adapted to actuate only the waste-disposal system 50 or only the conveying apparatus 66, or both the waste-disposal system 50 and the conveying apparatus 66, on receiving a triggering signal. In particular, it is conceivably possible for the waste-disposal system 50 to be actuated first, and the conveying apparatus 66 after that, with a time delay, by the triggering device 60. It is also conceivably possible for the sensor 62 (for instance the touch sensor 62*b*) to also be actuated via a suitable coupling system when the activator 64 is actuated, and vice versa.

The transmission 76*a* of the slide 64*a* is represented in the forms of embodiment shown in FIGS. 2*b* and 3*b*. This transmission produces a direct mechanical connection between the slide 64*a* and the conveying carriage 72 in such a way that a movement of said slide is converted into a corresponding movement of said conveying carriage 72.

The transmission 76*b* of the foot pedal 64*b* is represented in the form of embodiment shown in FIG. 3*b*. Said transmission 76*b* converts an actuating movement of the foot pedal 64*b* into a translational movement of a piston 78 which is received in a cylinder 80 in which a pneumatic or hydraulic pressure is built up in the course of the actuating movement.

The activator 64 (in particular the slide 64*a* and/or the foot pedal 64*b*) may be pretensioned with the aid of a spring 82 in such a way that, when the spring 82 is in the non-tensioned state, the transmission 76*a*, 76*b* displaces the conveying carriage 72 into, and/or retains it in, its receiving state.

A plurality of disposable seating-surface covers 28 which are stacked on top of one another are received, in their storage state, in the storage reservoir 69. Said storage reservoir 69 can be brought into the toilet module 10 with the aid of a carrier device 84 which is accessible from outside via a flap 83; see FIGS. 2*b*, 3*b*, 5*a* and 5*b*. There are provided, in the storage reservoir 69, spacers 86 (see FIGS. 2*d* and 3*d*) which are adapted to space adjacent disposable seating-surface covers 28 apart from one another inside said storage reservoir 69 in such a way that the conveying apparatus 66 only receives one disposable seating-surface cover 28 when in the receiving state. The spacer 86 may also be realised with the aid of a local thickened portion of the base section 30.

The storage reservoir 69 also comprises a follow-up device 88 which is tensioned by a spring, for instance, and which is adapted to bring the disposable seating-surface covers 28 into, or retain them in, their storage state and to make them available to the conveying apparatus 66 for receiving purposes.

The toilet lid is represented again in cross-section in FIGS. 2*c* and 3*c*. Said toilet lid 14 comprises a foam core 90 consisting of a sound-damping material. The toilet surround 16 also comprises a foam core 92 consisting of a sound-damping material; see FIGS. 2*b*, 3*b*. Said toilet surround 16 is arranged in such a way, relative to the toilet lid 14, that said toilet lid 14 and said toilet surround 16 form a seating surface that terminates in a substantially flush manner (see FIGS. 4 and 5*a*) when the toilet lid 14 is in the concealing state, and reduce the noise emissions that emanate from the toilet module 10 and are caused by the latter's waste-disposal system 50.

The invention claimed is:

1. A disposable seating-surface cover for a toilet-seat flap which cover is configured to cover a seating surface of the toilet-seat flap in order to avoid contact between a user and said toilet-seat flap, the disposable seating-surface cover comprising:

a deformable or foldable base with an aperture, wherein the base comprises at least one adhesive section made of a paramagnetic or ferromagnetic material.

2. The disposable seating-surface cover according to claim 1, wherein the adhesive section is constructed as a metal strip which is incorporated in the base section.

3. The disposable seating-surface cover according to claim 1, wherein the base section has a substantially rectangular outer periphery and also a substantially elliptical inner periphery, and the adhesive section is arranged between the outer periphery and the inner periphery of the base section.

4. The disposable seating-surface cover according to claim 1, further comprising a plurality of adhesive sections, wherein said adhesive sections are arranged, relative to one another, in such a way that, when a spatial movement occurs, the adhesive sections describe paths of motion along the direction of movement of said disposable seating-surface cover that extend parallel and in a manner spaced apart from one another.

5. The disposable seating-surface cover according to claim 1, wherein the base section has a substantially rectangular outer periphery and also a substantially elliptical inner periphery, and the adhesive section is arranged in the region of the corners of said outer periphery.

6. The disposable seating-surface according to claim 1, wherein the base section is structured to enable the disposable seating-surface cover to be folded, deformed or crumpled to a compact size in such a way that, in its compacted state, said disposable seating-surface cover can be disposed of without difficulty through a standard or conventional waste-disposal line belonging to a toilet module for installation in an aircraft.

7. A toilet module, for installation in an aircraft, comprising:

a toilet-seat flap with a seating surface; and a retaining apparatus which is configured to retain a disposable seating-surface cover;

wherein the disposable seating-surface cover is configured to cover a seating surface of the toilet-seat flap in order to avoid contact between a user and said toilet-seat flap, wherein the disposable seating-surface cover comprises a deformable or foldable base with an aperture;

wherein the base comprises at least one adhesive section made of a paramagnetic or ferromagnetic material; and wherein, in a state of use, for the purpose of retaining said disposable seating-surface cover in the state of use, a magnetic force operates between the adhesive section of the disposable seating-surface cover and the retaining apparatus.

8. The toilet module according to claim 7, wherein the base of the disposable seating-surface cover has an inner periphery which is smaller than a periphery of an aperture in the toilet-seat flap.

9. The toilet module according to claim 7, wherein the retaining apparatus comprises at least one magnet, wherein the adhesive section in the disposable seating-surface cover and the magnet in the retaining apparatus are arranged and/or coordinated with one another in such a way that, when the disposable seating-surface cover is in the state of use, the magnetic force that operates between the adhesive section and the magnet of the retaining apparatus has a retaining value.

10. The toilet module according to claim 7, further comprising a waste-disposal system which is configured to release the disposable seating-surface cover from the retaining apparatus, out of the state of use, with the aid of a sucking-away flow, and to convey it away towards a receiving compartment, wherein a spacer is provided so that the disposable seating-surface cover is retained in the state of use exclusively by the retaining apparatus.

11. The toilet module according to claim 7, further comprising a conveying apparatus which is configured to receive the disposable seating-surface cover when the latter is in a storage state, to convey it onto the seating surface of the toilet-seat flap and to deposit said disposable seating-surface cover in the state of use, wherein a magnetic force operates between the disposable seating-surface cover and the conveying apparatus, for the purpose of conveying said disposable seating-surface cover.

12. Toilet The toilet module according to claim 11, wherein the conveying apparatus comprises at least one magnet, wherein the adhesive section in the disposable seating-surface cover and the magnet in the conveying apparatus are arranged and/or coordinated with one another in such a way that, during the conveying of the disposable seating-surface cover, the magnetic force that operates between the adhesive section and the magnet of the conveying apparatus has a conveying value.

13. The toilet module according to claim 12, wherein the retaining value of the magnetic force that operates, when the disposable seating-surface cover is in the state of use, between the adhesive section and the magnet of the retaining apparatus is greater than the conveying value of the magnetic force that operates, when the disposable seating-surface cover is in the conveying state, between the adhesive section and the magnet of the conveying apparatus.

14. The toilet module according to claim 11, wherein the conveying apparatus comprises at least one rail which extends substantially parallel to the seating surface of the toilet-seat flap and with the aid of which a conveying carriage is mounted so as to be displaceable between a receiving state, in which the conveying apparatus receives the disposable seating-surface cover in the storage state, and a depositing state, in which said conveying apparatus deposits the disposable seating-surface cover on the seating surface of the toilet-seat flap in the state of use, wherein a plurality of magnets belonging to the conveying apparatus are arranged on the conveying carriage in such a way that, when said conveying carriage is displaced, said magnets describe paths of motion that are parallel and spaced apart from one another.

15. The toilet module according to claim 14, further comprising a slide and/or a pedal, which is/are configured to displace the conveying carriage between the receiving state and the depositing state with the aid of a transmission of mechanical, kinematic, hydraulic and/or pneumatic construction.

16. The toilet module according to claim 7, further comprising a storage reservoir in which a plurality of disposable seating-surface covers stacked on top of one another can be received in the storage state, wherein at least one spacer is provided which is configured to space adjacent disposable seating-surface covers apart from one another in such a way that the conveying apparatus receives only one disposable seating-surface cover and conveys it towards the toilet-seat flap.

17. The toilet module according to claim 7, further comprising a movable toilet lid which contains a sound-damping material and which is configured to conceal the toilet-seat flap when in a concealing state, and also by a toilet surround which contains a sound-damping material and which is arranged, relative to the toilet lid, in such a way that, in the concealing state, the toilet lid and the toilet surround form a seating surface that terminates in a substantially flush manner.

18. The toilet module according to claim 5, wherein the base section is structured to enable the disposable seating-surface cover to be folded, deformed or crumpled to a compact size in such a way that, in its compacted state, said disposable seating-surface cover can be disposed of without difficulty through a standard or conventional waste-disposal line belonging to a toilet module for installation in an aircraft.

* * * * *